US005918721A

United States Patent [19]

Weinberger

[11] Patent Number: 5,918,721

[45] Date of Patent: Jul. 6, 1999

[54] CAN COLLECTION APPARATUS

[76] Inventor: William D. Weinberger, 79 Country Club La., Las Vegas, Nev. 89109

[21] Appl. No.: 08/575,963

[22] Filed: Dec. 20, 1995

[51] Int. Cl.[6] ..... G07F 7/06

[52] U.S. Cl. ..... 194/208

[58] Field of Search ..... 194/206, 209, 194/212, 213, 205

[56] References Cited

U.S. PATENT DOCUMENTS

| | | | |
|---|---|---|---|
| 4,241,821 | 12/1980 | Wo et al. . | |
| 4,245,731 | 1/1981 | Herbst et al. . | |
| 4,248,334 | 2/1981 | Hanley et al. . | |
| 4,285,426 | 8/1981 | Cahill . | |
| 4,316,533 | 2/1982 | Hughes et al. . | |
| 4,324,325 | 4/1982 | Dewoolfson . | |
| 4,492,295 | 1/1985 | DeWoolfson . | |
| 4,499,984 | 2/1985 | Tuten et al. | 194/212 |
| 4,517,558 | 5/1985 | Davids | 273/143 R X |
| 4,653,627 | 3/1987 | Hampson et al. | 194/209 |
| 4,784,251 | 11/1988 | DeWoolfson | 194/209 |
| 4,953,682 | 9/1990 | Helbawi | 194/208 |
| 5,042,634 | 8/1991 | Gulmini | 194/209 |
| 5,111,927 | 5/1992 | Schulze | 194/209 |
| 5,161,661 | 11/1992 | Hammond | 194/209 |
| 5,239,920 | 8/1993 | Schuff et al. | 194/208 |
| 5,346,048 | 9/1994 | Wilhelm | 194/209 X |
| 5,402,872 | 4/1995 | Clurman | 194/209 |

FOREIGN PATENT DOCUMENTS

| | | | |
|---|---|---|---|
| 4-370896 | 12/1992 | Japan | 194/208 |
| 303137A1 | 2/1989 | Switzerland | 194/209 |

*Primary Examiner*—F. J. Bartuska
*Attorney, Agent, or Firm*—Jack C. Munro

[57] ABSTRACT

A can collection apparatus that permits the user to insert empty beverage cans, one at a time, into the apparatus. The apparatus ascertains whether the article inserted is a valid empty can or is not a valid empty can. If it is not a valid empty can, the article is dispensed through a discharge chute back to the user. If the article is a valid empty can, that empty can is moved to a can crusher where the can is crushed and deposited within a collection area. Simultaneously with the moving to the can crusher, a computer generated image of rotatable reels are spun, which then are stopped which display a coupon value for a product or products imprinted on a segment of each reel. A coupon value is then to be printed and dispensed to the user corresponding to the displayed coupon value.

1 Claim, 6 Drawing Sheets

CAN COLLECTION APPARATUS

BACKGROUND OF THE INVENTION

1) Field of the Invention

The subject matter of this invention relates to an apparatus that is designed to collect conventionally used empty aluminum beverage cans, crush these cans and store them within a collection container. Additionally, the apparatus includes a personal computer with a monitor screen which is programmed to resemble the spinnable reels of a conventional slot machine which are spun when the apparatus receives a valid empty can. When the reels are stopped a payout-line across the reels displays a coupon for a specific product at a value which is printed and dispensed to the user.

2) Description of the Prior Art

At the present time there is extensive effort being expended to recycle products as opposed to dumping of the products within landfills. Currently within the United States, there is being manufactured and used each and every year approximately 100 billion aluminum beverage cans. Used aluminum beverage cans can be recycled to produce new beverage cans or other aluminum parts. It is desirable when recycling beverage cans to condense in size the empty beverage can. If the can is not condensed in size, only a few hundred of these cans can be placed within a large sack, this sack weighing only a few pounds. The can could be crushed to be about 1/10 of its normal length and that same sack would then be able to hold over a thousand cans and still would not be exceedingly heavy weighing about forty pounds.

In the past, there has been utilized numerous types of devices for condensing of beverage cans. These types of devices are known as can crushers with one common type being a manually operated unit which provides for the insertion of one can at a time into the unit and to be manually operated to crush the can. The crushed can is then placed in an appropriate collection container.

There is also been utilized motorized can crushers basically similar to the manual unit previously described with the exception that the force used to crush the can is obtained from an electrically operated motor which works in conjunction with a hydraulic cylinder which does the actual crushing of the can.

It has been known in the past to incorporate a can collection apparatus in conjunction with a gaming apparatus with the intent and purpose being to entice people to utilize the collection apparatus. If the collection operation could be made to comprise entertainment, then individuals would be enticed to utilize the collection apparatus thereby recycling a greater percentage of beverage cans. Also, a game type of collection apparatus could be utilized as a means to advertise grocery type products with coupons being produced and distributed to the user that can be used to reduce the cost of grocery products within a grocery store.

A preferable location for collection apparatuses are at grocery stores. People frequently go to grocery stores and if the can collection apparatus was located adjacent to the front door of the grocery store, it would be convenient for individuals to use. Also, if the can collection apparatus distributed a coupon for a product that the user could use, then the user could take the coupon in the grocery store and purchase that particular product at a reduced cost.

A collection apparatus that includes a gaming type of device provides a win situation for the environment decreasing the amount of aluminum that must be mined each year and decreasing the number of beverage cans that are deposited within landfills, and also a win situation for manufacturers of products by encouraging consumers to purchase the product thereby increasing the business of the manufacturers that include coupons in the can collection apparatus. In the past there have been two known attempts to design a can collection apparatus which includes a gaming device. One such can collection apparatus is within U.S. Pat. No. 5,402,872, issued Apr. 4, 1995 to a Grant G. Clurman. This apparatus of Clurman is directed to a manually operated device which provides for the insertion of either plastic bottles or metallic beverage containers. These different types of containers are separated within the apparatus, the cans being crushed and the plastic containers shredded. The apparatus of Clurman does include a manually operated slot machine reel arrangement in which reels are to be spun and upon identical indicia being displayed at a payout-line across the reels, a prize is to be awarded. The disadvantage of Clurman is that it requires coins to be used by the user in order to operate the recycling apparatus. Most users are not inclined to spend money to recycle bottles and cans.

The second known apparatus is described with the U.S. Pat. No. 5,085,308, issued Feb. 4, 1992 to a Rene Wilhelm. This device includes a similar series of slot machine type reels which are to be spun into operation only upon sensing the admissability of an aluminum beverage can which then gives the user a chance of winning a prize corresponding to what is displayed on the reels after the reels have been stopped. One disadvantage of this particular apparatus is that it uses hydraulics in order to compress the beverage can. The hydraulic system is inherently subject to leakage and is also expensive to incorporate with such a can collection apparatus.

SUMMARY OF THE INVENTION

It is therefore a primary objective of the present invention to provide an improved apparatus for collecting used aluminum beverage cans for the purpose of recycling these cans.

Another objective of the present invention is to construct an apparatus which aids in cleaning up of the environment by eliminating the disposing of aluminum beverage cans in landfills.

Another objective of the present invention is to construct an apparatus which can be utilized as an advertising medium for manufacturers of products that are sold in grocery stores.

The apparatus of this invention includes a housing within which there is located an internal chamber. Within the internal chamber is located a collection area generally in the form of an open sack. Crushed cans from a can crusher located within the internal chamber are to be deposited within the open sack. The can collection apparatus of this invention is to only receive a valid empty can from a can identifying means also mounted within the internal chamber of the housing. The can identifying means permits valid empty cans to be conducted to a can crusher and invalid articles to be discharged through a discharge chute back to the user of the apparatus. Upon a valid empty can being transmitted to the can crusher, a slot machine type gaming apparatus displayed on a computer screen will be activated with spinnable reels on which are displayed items for one or more products. A coupon will then be printed and dispensed to the user with the user being able to use the coupon to obtain a reduced price of that product within a grocery store or other similar type of store.

DETAILED DESCRIPTION OF THE PREFERRED EMBODIMENT

Figure 2:
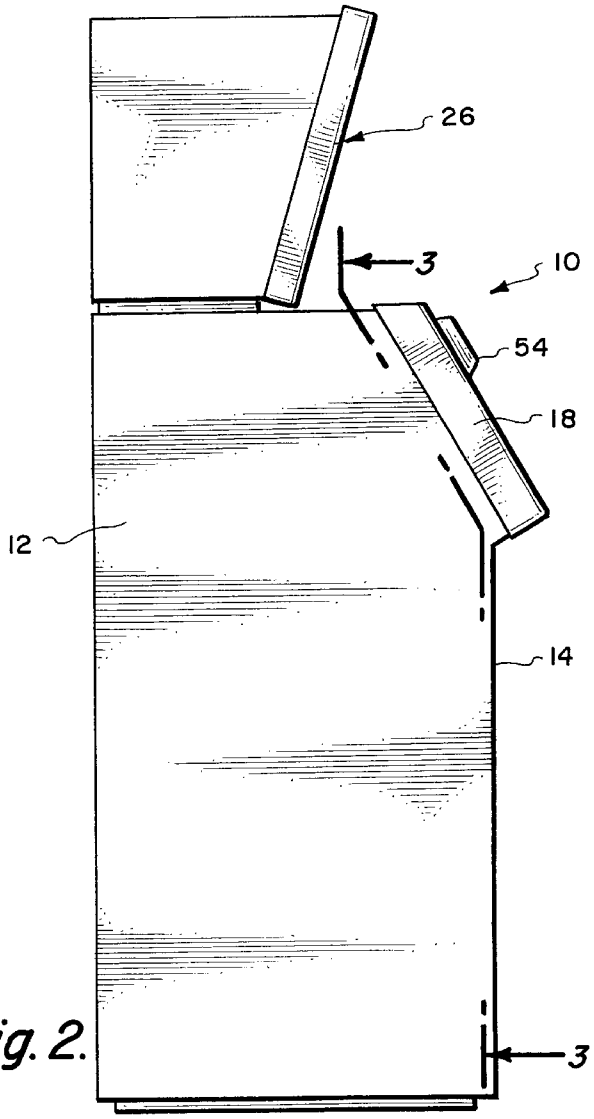
FIG. 2 is a left side view of the can collection apparatus of the present invention.
Figure 1:
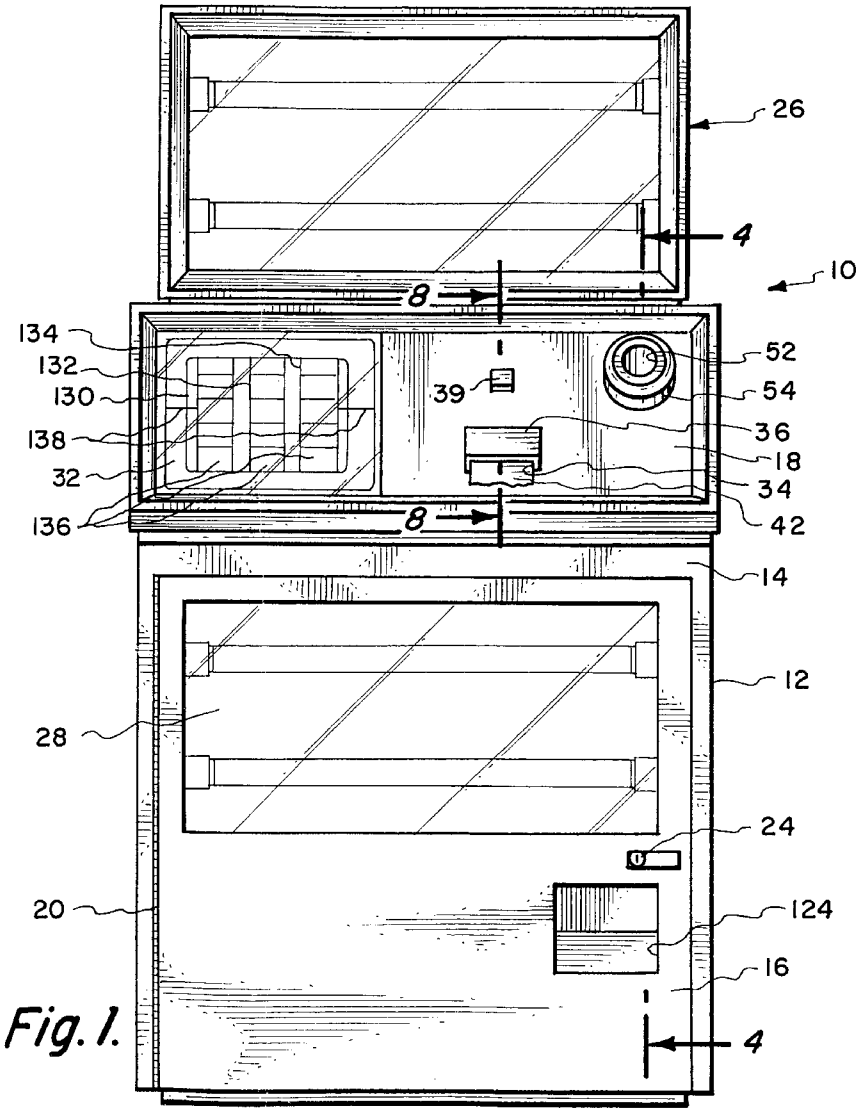
FIG. 1 is an exterior front view of the can collection apparatus of the present invention.
Figure 3:
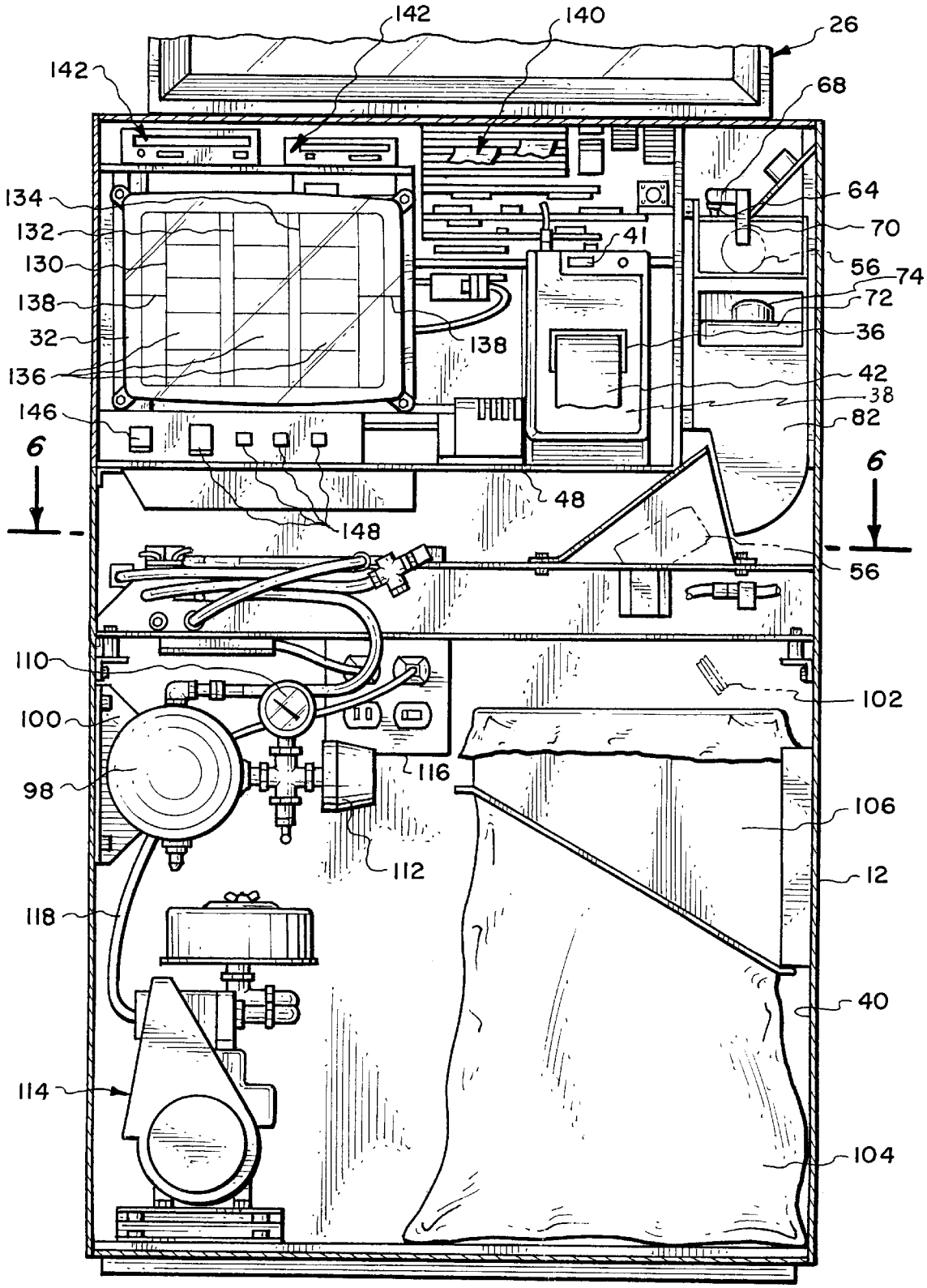
FIG. 3 is a cross-sectional front view of the mechanism located within the housing of the can collection apparatus of the present invention taken along line 3—3 of FIG. 2.
Figure 4:
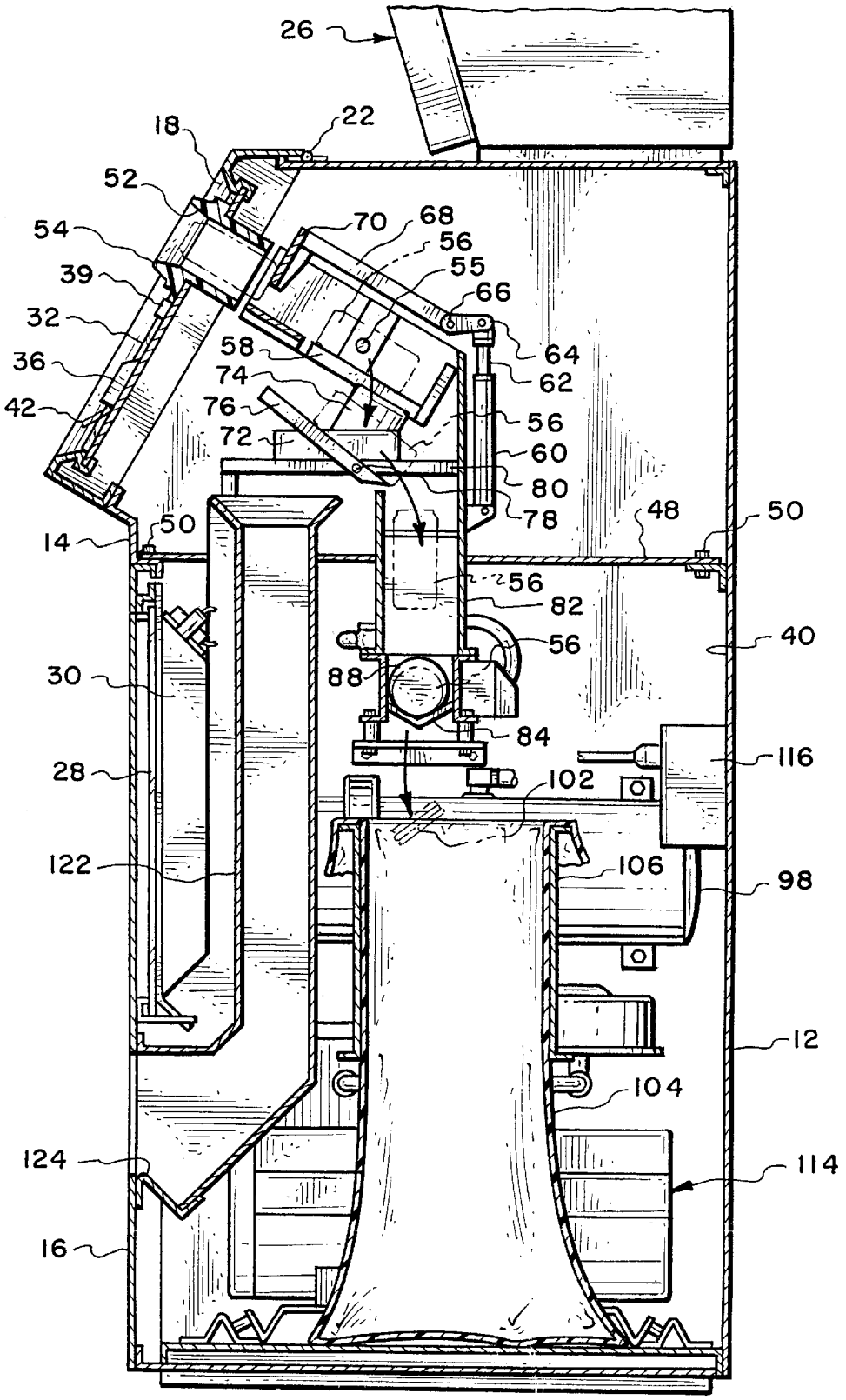
FIG. 4 is a side, cross-sectional view taken along line 4—4 of FIG. 1 showing the apparatus in the position of receiving a valid beverage can to be crushed and then depositing of that can within the collection area.

Referring particularly to the drawings, there is shown primarily in FIGS. 1 and 2 the can collection apparatus 10 of this invention which is formed of an enclosing housing 12. The housing 12 is basically constructed to be box-like having a front surface 14. The front surface 14 includes an enlarged door 16 which provides access into the lower end of the housing 12. The access into the upper portion of the housing 12 is obtained by means of door 18. Door 16 is hingedly connected by hinge assembly 20 to the housing 12. Door 18 is hingedly connected by hinge assembly 22, shown in FIG. 4, to the housing 12. Door 16 is to be locked when in a closed position as shown in FIG. 1 of the drawings by means of a key operated lock 24. Door 18 may also include a key operated lock (not shown) to secure the door 18 in the closed position.

Figure 8:
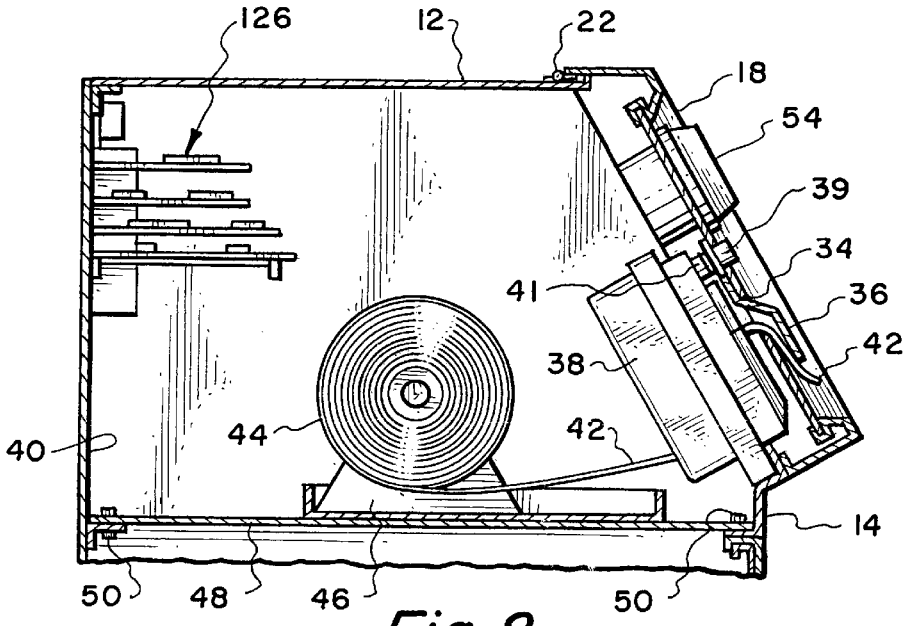
FIG. 8 is a cross-sectional view through the printer structure included in the can collection apparatus of the present invention taken along line 8—8 of FIG. 1.

Mounted on the top surface of the housing 12 is a display sign 26. This display sign 26 is for the purpose of displaying an advertising message which is not a specific part of this invention. Also, the door 16 may include an advertising area 28 which will also include similar types of advertising messages. The advertising area 28 may be illuminated by means of a lighting device 30 which is deemed to be conventional. Mounted within the door 18 is a transparent window 32. Also mounted within the door 18 is a slot 34. A cover 36 connects with the slot 34 with the cover 36 being mounted on the door 18. The printer 38 is deemed to be conventional and is mounted within the internal chamber 40 of the housing 12. The purpose of the cover 36 is to prevent entry of foreign material into the slot 34 but yet permit paper 42 upon which had been printed coupons by the printer 38 to be dispensed. The paper 42 comes from a supply roll 44 with this supply roll being rotatably mounted on brackets 46, shown in FIG. 8, which are fixedly mounted on divider wall 48 located within the internal chamber 40. Divider wall 48 is fixedly mounted by fasteners 50 to the wall of the internal chamber 40.

Also formed within the cover 18 is an access opening 52. This access opening 52 is formed by a collar 54 which is mounted in the door 18. The access opening 52 is of the size to just permit entry of an article which should comprise a valid empty beverage can 56. The article is inserted within the access opening 52 so that the sidewall of the beverage can 56 is located parallel to the wall of the access opening 52. The valid empty beverage can 56, after entering the access opening 52, comes to rest on cradle 58. Immediately upon the beverage can 56 passing the entry into the cradle 58, the actuator 60 is extended which extends the actuator rod 62. The actuator 60 is to be pneumatically operated. Extension of the rod 62 will pivot link 64. The link 64 is pivotally connected to a pivot pin 66 which is pivotally mounted relative to the housing 12. The pivot link 64 is fixedly connected to an arm 68 with the outer end of the arm 68 terminating in a stop plate 70. The stop plate 70 will be moved by actuator 60 to partially block the access opening 52 preventing the entry of more than one beverage can 56 into the cradle 58.

Figure 5:
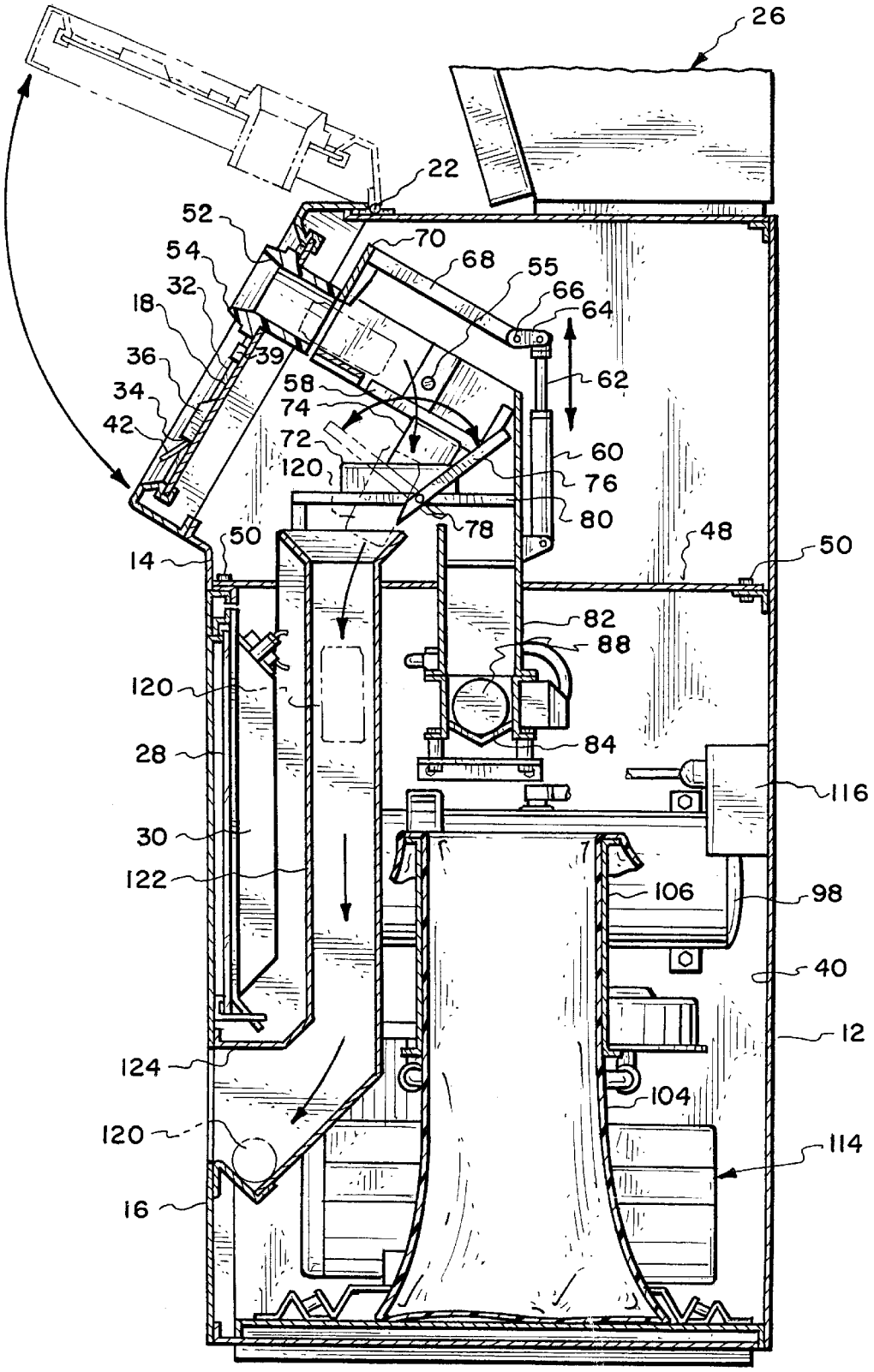
FIG. 5 is a cross-sectional view similar to FIG. 4 but showing the apparatus in the position of rejecting an inserted article which is not a valid empty beverage can.
Figure 6:
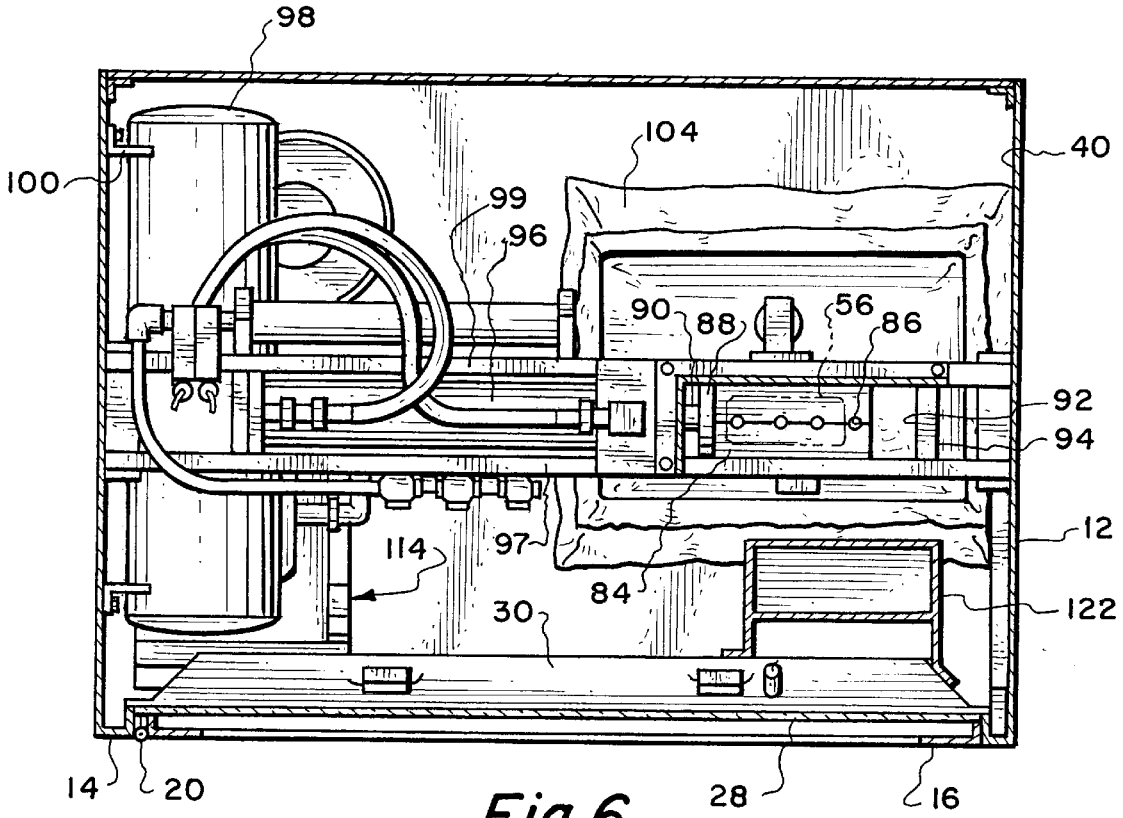
FIG. 6 is a cross-sectional view taken along line 6—6 of FIG. 3 showing in more detail the can crusher incorporated within the can collection apparatus of the present invention.

If the article 56 is a valid empty beverage can, the weight of it will be ascertained by a load cell 72. The cradle 58 is mounted by means of brackets 74 on the load cell 72. If the weight of the article 56 shows it to be a valid empty can, within a certain narrow range allowing for a small amount of liquid to be contained within the can 56, the can 56 will be ejected from the cradle 58 by means of a solenoid (not shown) which lineally moves a rod 55. Rod 55 will force can 56 off cradle 58 which will then fall onto deflector plate 76. The deflector plate 76 is pivotally mounted by pivot pins 78 onto wall member 80 which is fixedly mounted onto the chute 82. The deflector plate 78 is to be moved electrically by an appropriate mechanism (not shown) that either locates the deflector plate 76 in the position shown in FIG. 4 or in the position shown in FIG. 5. With the deflector plate in the position shown in FIG. 4, the article 56 has been determined by appropriate sensors, one of which is the load cell 72, to constitute a valid empty can. It is the function of the deflector plate 76 to deflect the article 56 into chute 82. From chute 82 the article 56 is directed onto crushing cradle 84.

Figure 7:
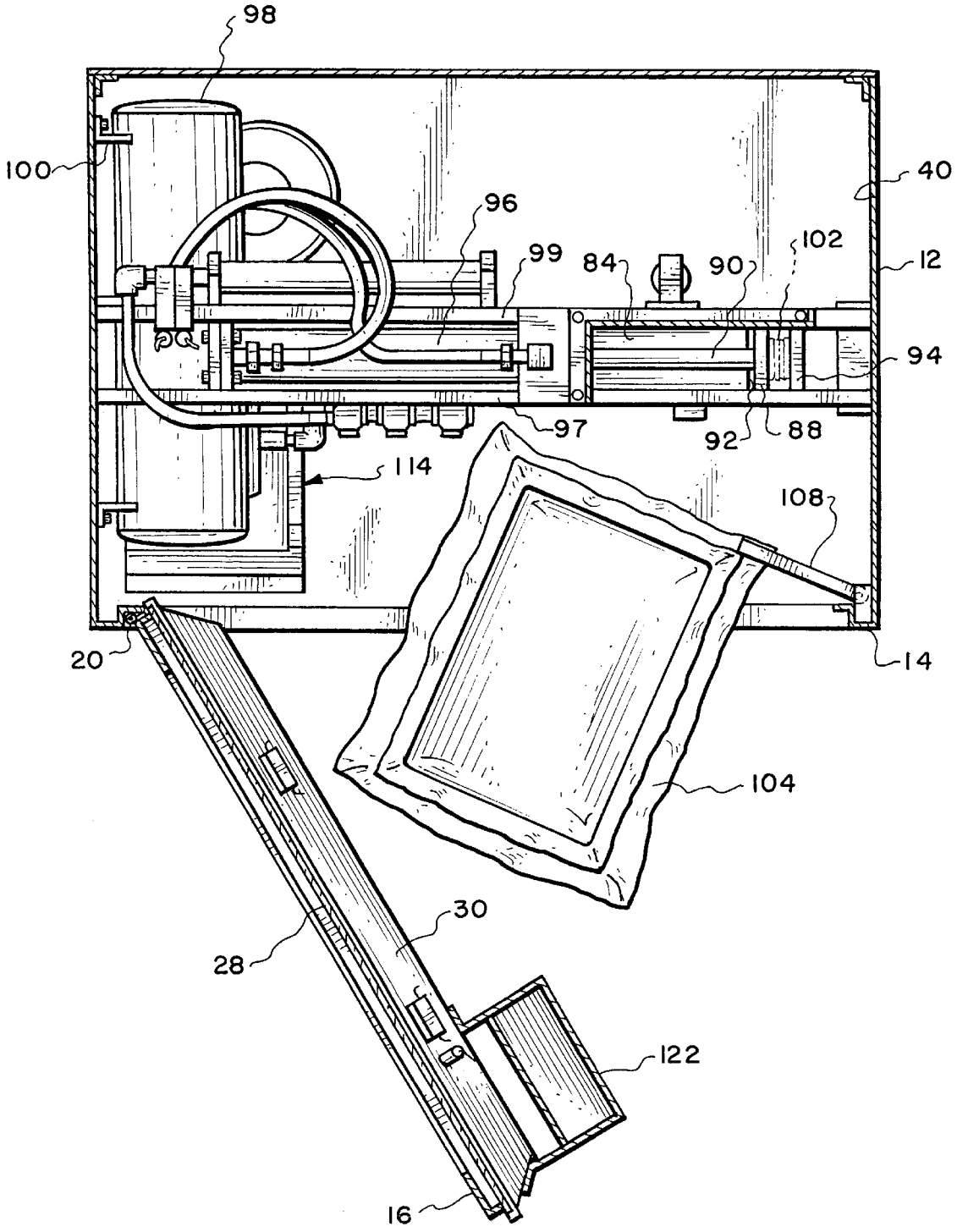
FIG. 7 is a view similar to FIG. 6 but with the front door of the can collection apparatus being shown in the open position and the mounting arrangement for the collection sack being pivoted to its outer position to facilitate disengagement of the sack for replacement.

The crushing cradle 84 is shown to be horizontal. This is important so that the sidewall of the valid empty can 56 rests on the crushing cradle 84. If there is any liquid within the valid empty can 56 that is ejected, it will automatically be caused to drain through drain holes 86 formed within the crushing cradle 84. The inner end of the crushing cradle 84 includes a piston 88. The piston 88 is connected to a rod 90. The outer end of the crushing cradle 84 includes a dispensing opening 92. The dispensing opening 92 is located between the crushing cradle 84 and an end wall 94. The rod 90 is to be lineally moved by an actuator 96. The actuator 96 is fixedly mounted between wall members 97 and 99 which are fixed to a wall of the housing 12. The actuator 96 is to be operated by pressurized air from a tank 98. The tank 98 is fixedly mounted to the wall of housing 12 by means of brackets 100. Upon a valid empty can 56 being deposited on the crushing cradle 84, air pressure is to be supplied to the actuator 96 which will cause the rod 90 to be extended causing the piston 88 to compress the valid empty can 56 into a condensed version 102 between the piston 88 and the end wall 94. After the piston 88 is moved to its maximum outward position as shown in FIG. 7 of the drawings, the piston 88 then retracts which will result in the condensed version 102 falling through dispensing opening 92 into a collection sack 104. The sack 104 is located directly beneath the dispensing opening 92 so that the condensed versions 102 will fall by gravity within the sack 104. The sack 104 is mounted on a mounting frame 106 which is pivotally mounted by arm 108 onto the wall of the housing 12. The arm 108 permits for pivoting movement of the mounting frame 106 and the sack 104 to a position exterior of the internal chamber 40 as is shown in FIG. 7 of the drawings. This will permit the sack 104 to be disengaged from the mounting frame 106 to provide for replacement of the sack 104 upon the sack 104 becoming substantially full of the condensed versions 102.

Connected to tank 98 is a pressure gauge 110. Connected to the pressure gauge 110 is a pressure regulator 112. Air is to be supplied into the tank 98 from an electrically actuated pump 114. The pump 114 is fixedly mounted on the housing 12 and located within the internal chamber 40. The pump 114 is electrically connected to socket panel 116 to which is supplied electrical energy from an exterior source. The pressurized air that is pumped by pump 114 is transmitted through tube 118 to the tank 98.

Let it be assumed that an article 56 is placed within the access opening 52 that is not a valid empty can. That article 56 would almost assuredly have a weight that is different than a valid empty can. The different weight would be picked up by the load cell 72. There also may be included a magnetic sensor (not shown) that will be shown to determine if the article is magnetic, and if it is, it will automatically be rejected since an aluminum can is not magnetic. When the article is discovered to be not a valid empty can, that article is ejected from the cradle 58 in exactly the same manner as was previously described by solenoid rod 55. However the deflector plate 76 is pivoted to the position shown in FIG. 5 blocking chute 82 and upon the article 120 contacting the deflector plate 76 it is automatically directed toward discharge chute 122. The article 120 comes to rest at the bottom of the discharge chute 122 and is to be returnable to the user on the can collection apparatus 10 by the individual reaching through opening 124 and extracting the article 120.

Let it be assumed that a valid empty can article 56 has been moved in contact with the crushing cradle 84. At that time, appropriated circuitries included within the can collection apparatus 10 mounted on printed circuit boards 126 activate a game device similar to a conventional slot machine. The game device includes the window 32 through which is to be observed computer images of what appears to be spinnable reels 130, 132 and 134. Each of the reels 130, 132 and 134 are divided into a plurality of segments 136. Each of the segments are normally of the same size and are capable of being imprinted with some type of a product identification. A typical product identification would be for a cleansing product, a food product and so forth that you would normally find within a grocery store. The imprinting on the segments 136 can be accomplished electronically through printed circuit boards 126 at a central location spaced from the apparatus 10. It is envisioned that there may be utilized thousands of the apparatuses 10 at numerous locations throughout the country and the imprinting of the segments 136 can be changed frequently. Manufacturers of product are to actually compensate the business owner of the apparatuses 10 for the advertising of their product or products on the segments 136.

It is understood that the reels 130, 132 and 134 will be independently spun and stopped randomly at different rates of rotation so that when the reels 130, 132 and 134 are stopped, that their position of stopping is independent of each other. This means that whatever segments 136 that align with the payout-line 138 is accomplished randomly. Let it be assumed that whatever coupon aligns with a segment 136 of reel 130 constitutes the smallest denomination of a value such as, for example, twenty cents. That means that each and every time that a valid empty can 56 comes to rest within the crushing cradle 84, automatically a coupon would be printed on the paper 42 corresponding to the coupon value for the particular product displayed on the segment 136 that aligns with the payout-line 138. Also incorporated on reel 132 is a segment 136 that corresponds to that exact same product. The value of reel 132 would normally be higher such as, for example, forty cents. If the segment 136 for that particular product also aligns with the payout-line 138, the total coupon value would be increased accordingly, that is from twenty cents adding to it the forty cents making a total of sixty cents, and that sixty cents coupon value would be printed out on the paper 42 and dispensed to the user. Now by chance, let it be assumed that same corresponding product within a segment 136 on the reel 134 also aligns with the payout-line 138. Let it be assumed that the value of each of the segments in reel 134 are sixty cents. If the coupon is the same as the coupons in reels 130 and 132 and aligns with payout-line 138, the total coupon value will be increased accordingly, making it a total of a $1.20 coupon which the user will save in choosing to purchase the product that is displayed on the segments 136 that are aligned with the payout-line 138. The user can actually extract the coupon from the paper 42 and take the coupon to an appropriate business establishment such as a grocery store, purchase the product and give the retailer the coupon and get the price of that product deducted accordingly.

It is to be understood that there is a coupon printed for each can 56 crushed. When a user has inserted his or her total number of cans 56 into the can collection apparatus, after insertion of the last can 56, the user pushes button 39 mounted in door 18. Button 39 is mounted on a base 41. Pushing of button 39 transmits a signal to the electronics causing a total coupon to be printed on paper 42 which will inform the user of the dollar and cents total coupon value plus the total dollar and cents value for recycling the cans 56.

Mounted within the internal chamber 40 are additional printed circuit boards 140. Appropriate electronic devices such as CD players and disc drives 142 are also included to be usable by on-site personnel to change the coupons located on the segments 136. The reels 130, 132 and 134 are electronic representations of reels on a monitor. Control of the monitor is to be achievable by an on-site individual by the use of on/off button 146 and other control buttons 148.

What is claimed is:

1. A can collection apparatus comprising:

a housing having an internal chamber and a frontal surface;

an access opening formed within said frontal surface permitting entry of an article into said internal chamber;

can identifying means located within said internal chamber, said can identifying means to determine if said article inserted into said access opening is a valid empty can or is not a valid empty can, said can identifying means including a deflector plate, said deflector plate to be in a first position if said article is a valid empty can and a second position if said article is other than a valid empty can;

a discharge chute connected to said can identifying means, upon an article which is not a valid empty can being inserted into said access opening said article being conducted into said discharge chute from said deflector plate which is in said second position;

a can crusher located within said internal chamber, said can crusher being connected to said can identifying means but spaced therefrom, upon a valid empty can being supplied to said can identifying means the valid empty can is moved to said can crusher with said deflector plate in said first position, said can crusher having a base upon which the valid empty can is to rest, said base including a dispensing opening, said can crusher including crushing means, said crushing means for collapsing the valid empty can to a size smaller than said dispensing opening with the crushed valid empty can to be then moved through said dispensing opening into a collection area;

a plurality of reels displayed within said internal chamber, said reels being located in juxtaposition, each said reel being separately spinnable by rotation means, said rotation means being actuated by a valid empty can moving into said can crusher, each said reel being divided into a plurality of separate segments, a coupon value located within each said segment with there being a plurality of different coupon values, after spinning of said reels said reels to come to rest aligning a segment from each said reel producing aligned segments and displaying of said aligned segments exteriorly of said frontal surface, said aligned segments represent a total coupon value to the user of said can collection apparatus;

a coupon printing apparatus for printing said total coupon value and dispensing such to the user; and there being at least three in number of said reels comprising a left reel and a right reel with an intermediate reel located between said left reel and said right reel, said coupon value being what is displayed on said left reel and any similar coupon value located on said intermediate reel and said right reel, said total coupon value adding the cumulated values of similar coupons within said aligned segments located at a payout line.

* * * * *